United States Patent [19]

Shallenberger

[11] 3,955,814

[45] May 11, 1976

[54] BALANCING TOY WITH ENDS OF SOCKETS AND PROTRUSIONS

[76] Inventor: Lester G. Shallenberger, 1625 N. 8th St., Springfield, Ill. 62702

[22] Filed: Feb. 20, 1975

[21] Appl. No.: 551,073

[52] U.S. Cl. ..... 273/1 R; 46/25; 46/28

[51] Int. Cl.[2] ..... A63H 3/16

[58] Field of Search ..... 273/1 R; 46/27, 28, 46/29, 24, 25, 26; 35/16, 18 R, 18 A

[56] References Cited

UNITED STATES PATENTS

| | | | |
|---|---|---|---|
| 1,400,066 | 12/1921 | Huck | 46/29 |
| 2,662,335 | 12/1953 | Calverley | 46/28 X |
| 3,230,643 | 1/1966 | Mathus | 46/29 X |
| 3,550,311 | 12/1970 | Fouquart | 46/28 |

FOREIGN PATENTS OR APPLICATIONS

| | | | |
|---|---|---|---|
| 625,076 | 6/1949 | United Kingdom | 46/25 |

*Primary Examiner*—Paul E. Shapiro
*Assistant Examiner*—William R. Browne
*Attorney, Agent, or Firm*—Grace J. Fishel

[57] ABSTRACT

Interengageable balancing toys, particularly suited for children but also for amusement of adults, each such toy including an elongated body having only rounded protrusions at one end and only sockets at the other, said socket of one balancing toy detachably receiving the rounded protrusion of another similar toy.

10 Claims, 6 Drawing Figures

BALANCING TOY WITH ENDS OF SOCKETS AND PROTRUSIONS

This invention relates to a balancing toy which is constructed to require sustained coordination of anyone trying to balance several such toys.

The prior art is replete with balancing toys, some of which have one or more pivoted elements associated with a base resting on a stable surface, e.g. U.S. Pat. No. 1,235,050 and U.S. Pat. No. 3,092,384. These toys require a steady hand while initially placing the pivoted element but, once placed, the pivoted element is either in a stable condition or the toy topples.

Among the several objects of the present invention may be noted the provision of a construction, several units of which comprise a dynamic toy, which construction requires sustained concentration and coordination and which construction is supported throughout use by the player. Other objects and features will be in part apparent and in part pointed out hereinafter.

The invention accordingly comprises the constructions hereinafter described, the scope of the invention being indicated in the following claims.

In the accompanying drawings, in which several of various possible embodiments of the invention are illustrated, FIG. 1 is a perspective view, partially broken away, of the balancing toy and showing in broken lines, also partially broken away, two similar balancing toys;

Figures 1, 2, 3, 4, 5, 6:
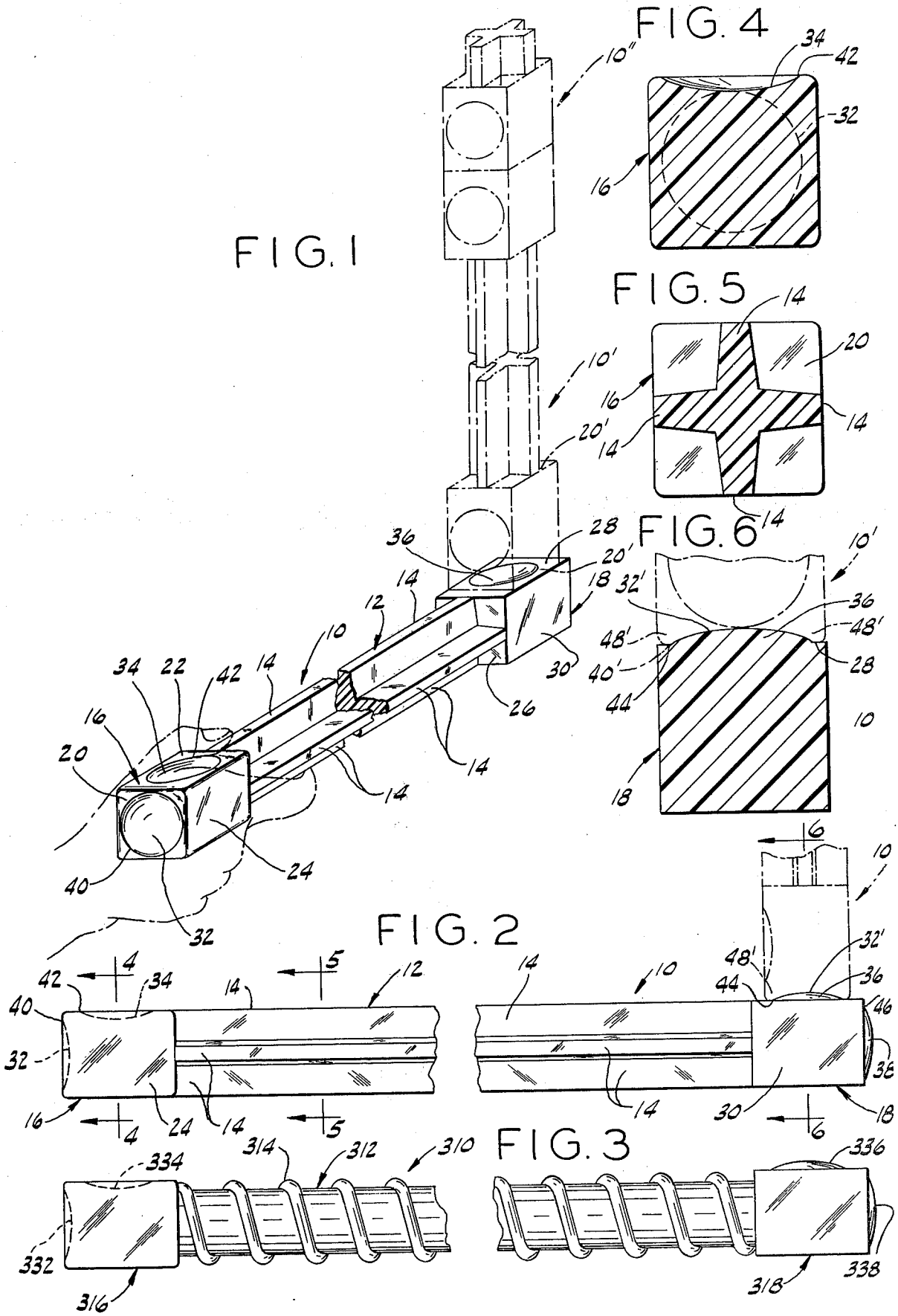
FIG. 2 is an enlarged side elevational view, partially broken away, of the balancing toy and showing in broken lines a fragment of the second balancing toy.
FIG. 3 is a side elevational view of another form of the balancing toy.
FIG. 4 is a sectional view taken along line 4—4 of FIG. 2.
FIG. 5 is a sectional view taken along line 5—5 of FIG. 2.
FIG. 6 is a sectional view taken along line 6—6 of FIG. 2.

Referring to FIG. 1, one embodiment of a balancing toy 10 includes an elongated body or shaft 12 having a plurality of fins 14 integrally formed thereon. As best seen in FIG. 5, fins 14 are preferably four in number and positioned at right angles to one another.

At opposite ends of shaft 12 are blocks or members 16 and 18. Block 16 has three pairs of parallel plane surfaces 20, 20; 22, 22 and 24, 24 and block 18 similarly has three pairs of parallel plane surfaces 26, 26; 28, 28 and 30, 30. As shown in FIGS. 1 and 2, corresponding faces of each block 16 and 18 are coplanar, i.e., faces 20, 20 are coplanar with faces 26, 26 while faces 22, 22 and 28, 28 like faces 24, 24 and 30, 30 are coplanar.

Concave recesses or sockets 32 and 34 are provided in surfaces 20 and 22 of block 16, and convex rounded protrusions 36 and 38 are provided on surfaces 26 and 28 of block 18. As shown, sockets 32 and 34 and rounded protrusions 36 and 38 are on corresponding surfaces of blocks 16 and 18 and are in mirror plane relationship. Socket 32 and protrusion 38 face outwardly on opposite ends of toy 10 and socket 34 and protrusion 36 face upwardly at right angles to the long axis of the toy. Rounded protrusions 36 and 38 are adapted to be slippingly received in sockets 32 and 34 for use as described hereinafter.

While blocks 16 and 18 are shown as hexahedrons with surfaces 22, 22; 24, 24; 28, 28 and 30, 30 similarly sized, they may independently be shaped and sized as cubes or some other polyhedra as long as faces 20 and 22 are larger than bases 40 and 42 of sockets 32 and 34. Similarly faces 26 and 28 must be larger than bases 44 and 46 of rounded protrusions 36 and 38. Although protrusions 36 and 38 are shown as spherical sections, they may be formed out-of-round if sockets 32 and 34 are cooperatively shaped to slippingly receive them.

Another embodiment of a balancing toy 310 is shown in FIG. 3. In this embodiment elongated shaft 312 has ridge 314 spiraled therealong. Like toy 10, toy 310 includes blocks 316 and 318 with rounded protrusions 336 and 338 which are adapted to be slippingly received in recesses 332 and 334 for use like toy 10 as shown in FIG. 1 and described below.

Toy constructions 10 or 310 are preferably molded of plastic as one piece but can be fabricated, for example, of metal or the like with blocks 16 and 18 or 316 and 318 affixed to shaft 12 or 312.

In use, as shown in FIG. 1, the player grips the operator end of toy 10 in such a way that rounded protrusion 36 on surface 28 is presented in a generally upwardly facing direction. Protrusion 36 is slippingly received in socket 32′ of a second toy 10′. As best seen in FIGS. 2 and 6, rim 48′ of socket 32′ (toy 10′) rests on surface 28 (toy 10) so that second toy 10′ is maintained in upright condition.

It should be apparent that the contact surface between rim 48′ and surface 28 should be sufficient to support toy 10′ only to the extent desired. Otherwise, stacked toys 10 and 10′ would be too stable in balanced condition. As shown, protrusion 36 is about one-eighth inch high and socket 32′ is about one-eighth inch deep and they are about one-quarter inch in diameter at bases 44 and 40′. Surface 28 is about one inch by three-quarters inch and surface 20′ is about three-quarters inch square. Other dimensions providing toys with selected degrees of balancing difficulty may be formed, designed to challenge the skill and coordination of the intended user.

With the second toy 10′ in balanced position, a third toy 10″ may be stacked on the second with protrusion 38′ (not shown) on surface 26′ (not shown) received in socket 32″ (not shown) of toy 10″.

Additional toys can be balanced end for end until the player is no longer able to hold them in stable condition. Skilled players are able to stack second toy 10′ on first toy 10 by tumbling second toy 10′ in the air and catching its socket 32′ on either protrusion 36 or 38 of toy 10. Occasionally, more toys can be serially tumbled and balanced by the player.

It is also possible that toys 10, 10′ and 10″ be balanced in a generally vertical position. In this condition, protrusion 38 would be received in socket 32′ of second toy 10′ and so forth. Similarly, toy 10 can be held by block 18 so that protrusion 38′ (not shown) of toy 10′ is slippingly received in socket 32 or 34 of toy 10 as desired. In any event, the player must continuously concentrate to maintain the toys in balanced condition.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. A balancing toy to be used in multiples comprising an elongated body and having first and second members at respective opposite ends, each said member having a plurality of surfaces said first member having one rounded socket in at least one of said surfaces and said second member having one rounded protrusion on at least one of said surfaces, said first member surfaces having only at least one socket and said second member surface having only at least one protrusion, and said toy being detachably receivable in another similar toy for the insertion of a protrusion of one toy into the socket of another similar toy.

2. A balancing toy according to claim 1 wherein the first and second members are hexahedral blocks and wherein said socket is concave and said protrusion is convex, said socket and said protrusion dimensioned to occupy substantially all of the associated face.

3. A balancing toy according to claim 2 wherein corresponding faces of each block are coplanar and wherein one socket is positioned so as to receive the protrusion of a second balancing toy when the long axes of said toys are in colinear alignment.

4. A balancing toy according to claim 2 wherein corresponding faces of each block are coplanar and wherein one protrusion is positioned so as to be received in the socket of a second balancing toy when the long axes of said toys are in colinear alignment.

5. A balancing toy according to claim 2 wherein corresponding faces of each block are coplanar and wherein one socket is positioned so as to receive the protrusion of a second balancing toy when the long axes of said toys are in perpendicular relationship.

6. A balancing toy according to claim 2 wherein corresponding faces of each block are coplanar and wherein one protrusion is positioned so as to be received in the socket of a second balancing toy when the long axes of said toys are in perpendicular relationship.

7. A balancing toy according to claim 2 wherein corresponding faces of each block are coplanar and wherein there is at least one socket associated with the first block and at least one protrusion associated with the second block, said socket and said rounded protrusion being on surfaces of said blocks in mirror plane relationship.

8. A balancing toy according to claim 2 wherein corresponding faces of each block are coplanar and wherein there are two sockets associated with the first block and there are two rounded protrusions associated with the second block, said sockets and said rounded protrusions being on surfaces of said blocks in mirror plane relationship.

9. A balancing toy according to claim 8 wherein the toy is formed of plastic and wherein the elongated body includes four parallel fins disposed at right angles to each other.

10. A balancing toy according to claim 8 wherein the toy is formed of plastic and wherein the elongated body includes at least one fin twisted about the long axis of the body.

* * * * *

UNITED STATES PATENT OFFICE

CERTIFICATE OF CORRECTION

PATENT NO. : 3,955,814

DATED : May 11, 1976

INVENTOR(S) : Lester G. Shallenberger

It is certified that error appears in the above-identified patent and that said Letters Patent are hereby corrected as shown below:

Column 3, claim 1, line 12 "surface" should be "surfaces".

Signed and Sealed this

Thirty-first Day of August 1976

[SEAL]

*Attest:*

RUTH C. MASON
*Attesting Officer*

C. MARSHALL DANN
*Commissioner of Patents and Trademarks*